United States Patent [19]

Hudson

[11] Patent Number: 4,584,813

[45] Date of Patent: Apr. 29, 1986

[54] METHOD FOR INSTALLING A HANGER FOR A STRUCTURAL MEMBER

[76] Inventor: John T. Hudson, 4018 E. Devonshire, Phoenix, Ariz. 85018

[21] Appl. No.: 485,596

[22] Filed: Apr. 18, 1983

[51] Int. Cl.[4] ..... E04B 1/38

[52] U.S. Cl. ..... 52/744; 52/702; 52/712; 248/214

[58] Field of Search ..... 52/289, 702, 703, 704, 52/707, 295, 296, 297, 365, 370, 698, 712–715, 721, 741–744; 248/214, 215; 403/232.1, 236.6

[56] References Cited

U.S. PATENT DOCUMENTS

| | | | |
|---|---|---|---|
| 950,361 | 2/1910 | Woods | 248/214 |
| 2,083,615 | 6/1937 | Reed | 52/713 |
| 2,500,635 | 3/1950 | Isakson | 52/702 |
| 2,699,312 | 1/1955 | Cesare | 52/712 |
| 3,342,005 | 9/1967 | Rickards et al. | 52/702 |
| 3,420,560 | 1/1969 | Pfahning | 52/702 |
| 3,972,168 | 8/1976 | Allen | 52/702 |
| 4,387,543 | 6/1983 | Tschan et al. | 52/707 |

OTHER PUBLICATIONS

1979 Sweet's Catalog File, Pivot Anchors, 6.6 Ea p. 2, McGraw-Hill Information Systems Co.

*Primary Examiner*—John E. Murtagh
*Assistant Examiner*—Andrew Joseph Rudy
*Attorney, Agent, or Firm*—Gregory J. Nelson

[57] ABSTRACT

A construction apparatus and method for securing a roof or floor support to a masonary wall. The apparatus includes a U-shaped bracket and a projecting anchor member. The anchor member is secured in the block wall by breaking a portion of the wall out and grouting the hanger in place. The U-shaped bracket receives and supports the beam or timber in a horizontal position. In the method of the construction, a plurality of hangers are placed in spaced-apart relationship.

3 Claims, 5 Drawing Figures

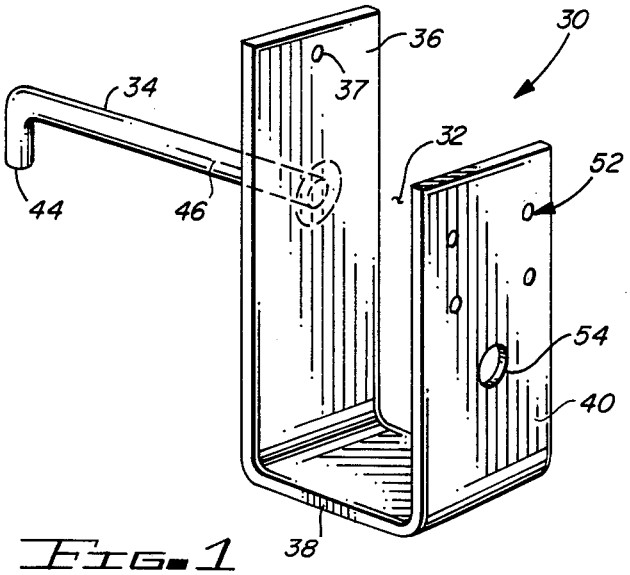
FIG. 1
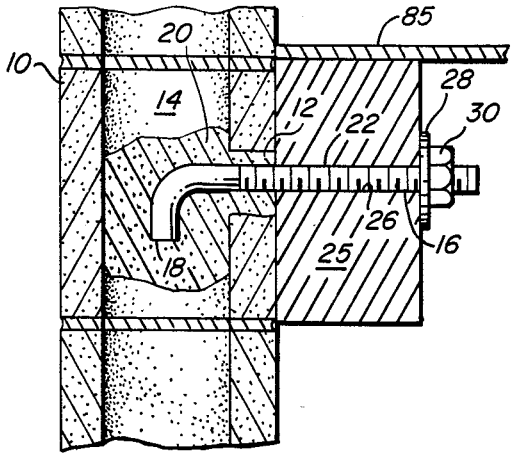
FIG. 2
(PRIOR ART)
FIG. 3
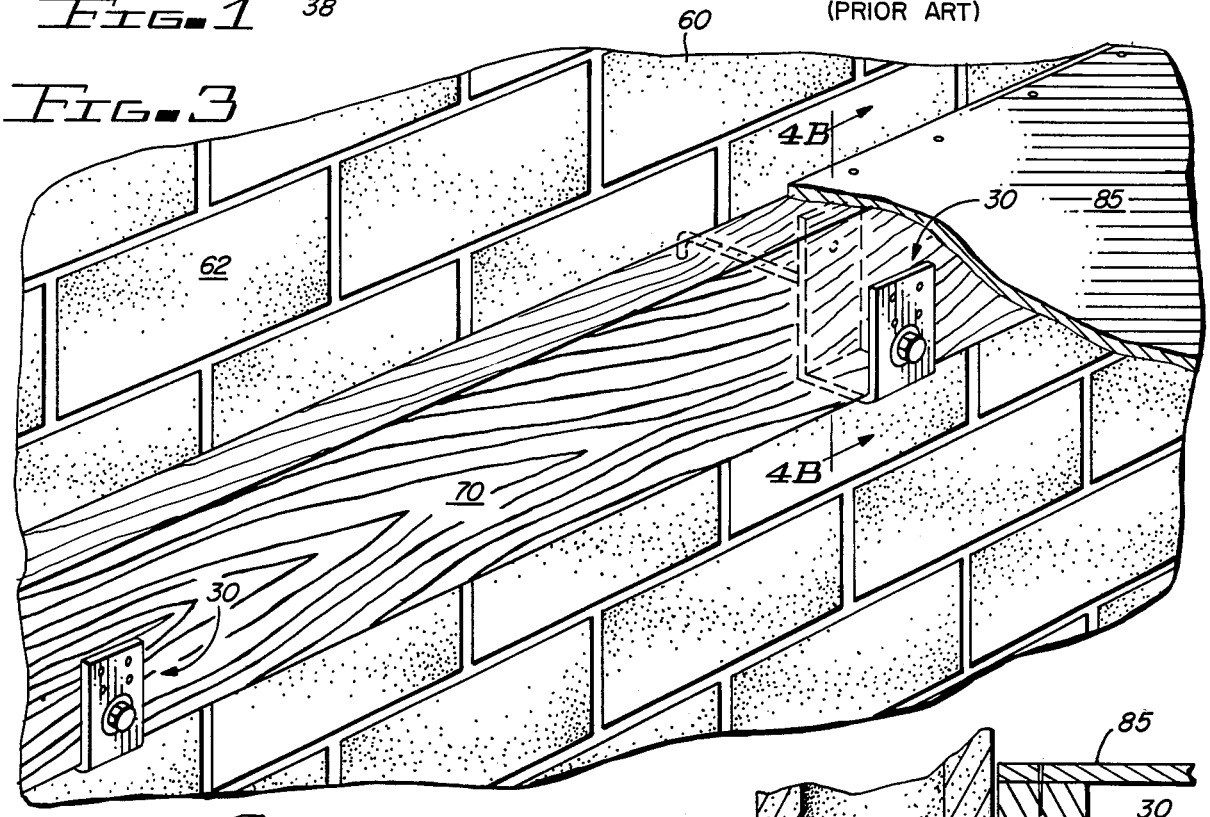
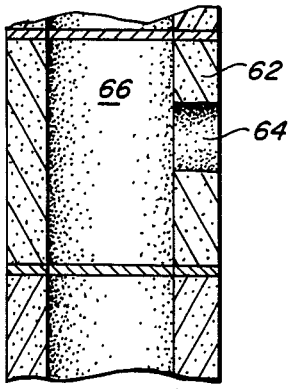
FIG. 4A
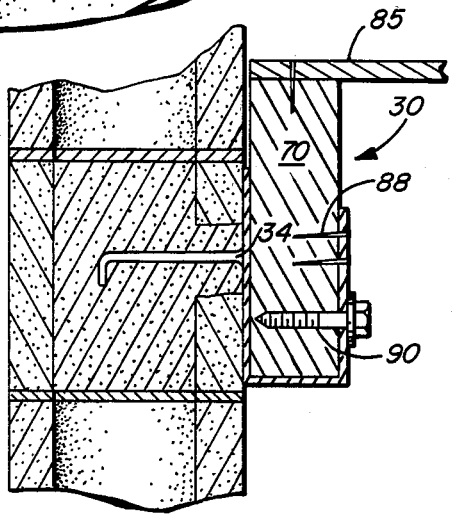
FIG. 4B

METHOD FOR INSTALLING A HANGER FOR A STRUCTURAL MEMBER

The present invention relates generally to a hanger for structural members and more particularly relates to a hanger for securing a roof or floor support member to a masonary wall.

In the building construction industry, it is a common method of construction to secure roof and floor supporting structural members to a masonary wall by anchor bolts. With this construction method, the wall consisting of typically concrete blocks is first erected. The interior of the wall at selected locations is broken away and L-shaped anchor bolts are inserted into the hollow interior of the block at the broken-away locations. The anchor bolts are then secured in place by appropriate grouting with cementitious material. Once the grouting is dry, a horizontal structural member, termed a "ledger" in the construction industry, is predrilled and secured to the wall.

Various problems can occur with this construction technique as it is a diffucult procedure to determine the exact drilling locations in order to align the ledger with the anchor bolts. Further, by drilling a hole through the ledger, the structural integrity of the ledger is substantially reduced.

In addition, the cost of this type of construction is substantial as labor is involved both in securing the anchor bolts to the masonary wall and in drilling and placing th ledger structural member in place.

Accordingly, there exists a need for an improved construction device and method to allow contractors to efficiently and easily secure ledger members to masonary walls in the construction of a building.

Briefly, the present invention provides a structural apparatus and method for this purpose. The structural apparatus consists of a generally U-shaped bracket which is adapted to receive the ledger member. The bracket includes an anchor member which is adapted to be secured in a masonary wall. Once the bracket is secured in place in the masonary wall, the ledger can be placed into the bracket without any requirement of drilling or the like. The bracket may include one or more holes so that mechanical fastener such as nails or screws can be extended between the bracket and the ledger to resist various loads such as wind and seismic loads.

The above and other advantages of the present invention will become more apparant from the following description, claims and drawings in which:

FIG. 1 is a perspective view of the hanger of the present invention;

FIG. 2 is a sectional view illustrating conventional construction techniques for securement of a ledger to a masonary wall;

FIG. 3 is a perspective view illustrating the construction method of the present invention;

FIG. 4A is a sectional view illustrating the initial step in the method of the present invention; and FIG. 4B is a sectional view illustrating the hanger secured to the wall with the ledger in position.

As briefly described above, in the construction of buildings particularly commercial construction, the use of masonary walls is common. Generally a footing is poured and concrete blocks are layed in place to the desired height. In order to form a roof or floor for the structure, it is customary practice to break away the interior wall of selected blocks at the desired elevations at which the roof or floor is to be placed. Concrete blocks are typically hollow and when the exterior wall is broken away, an anchor bolt can be secured in place with grout.

Referring to FIG. 2, the prior art construction is illlustrated in which a wall is shown consisting of a plurality of concrete blocks 10. A concrete block 10 at a selected location corresponding to the elevation of the floor or ceiling is broken away at 12 to permit access to the hollow interior 14 of the block 10. Anchor bolt 16 is then positioned in the block with the inner L-shaped leg 18 of the anchor in the hollow interior 14 of the block. Appropriate grouting 20 is placed around the inner end of the bolt and the broken-away portion of the block to secure the anchors. The projecting outer end of anchor bolt 16 is provided with threads 22. This procedure is repeated at spaced-apart horizontal locations. Ledger members 25, which typically may be a wooden timber such as a 4"×8", is provided with bores 26 at predrilled locations corresponding to the position of the anchor bolts 16. The ledger member 25 is positioned with the anchor bolts extending through the bores 26. Appropriate washers 28 and nut 30 are positioned at the outer end of the anchor bolt to tightly engage the timber and to secure the ledger to the wall. The roof or floor member 29 can then be secured at the ledgers 25.

A principal problem with the prior art method shown in FIG. 2 is in that the drilling of bores 26 substantially weakens the structural integrity of the ledger 25. Further, since beam 25 must be drilled at multiple locations corresponding to the position of the anchor bolts, misdrilling often occurs as it is not easy to precisely align the holes and the bolts. This type of construction also requires that a substantial number of anchor bolts be positioned in the wall. Depending on the type of construction, type of timbers and applicable building codes, it is not uncommon for anchor bolts to be placed on as little as one foot centers. The cost of the anchor bolts and the labor involved in securing the bolts in place and drilling the ledger is a substantial factor in construction of this type.

The present invention represents a substantial improvement over the prior method described above. The hanger and construction member of the present invention is illustrated in FIGS. 1, 3, 4A and 4B. Referring to FIG. 1, the hanger of the present invention is generally disignated by the numeral 30 and includes a generally U-shaped bracket member 32 and an anchor member 34. The U-shaped hanger member 32 includes a rear leg 36, bight section 38, and front leg 40. The front and rear legs 40 and 36 are in parallel relationship one to the other and spaced apart a distance to accomodate the particular size of wooden beam or timber. For example, with a typical 4" wide beam member, the spacing between the legs would be approximately $3\frac{5}{8}$". Preferably the rear leg is of greater height than the front leg. Typically, for most applications, the height of the rear leg would be about 8" with the height of the front leg about 6".

The anchor member 34 is generally L-shaped having inner end 44 which is disposed at right angles with respect to the shank portion 46. The end of the shank 46 is secured to the rear side of leg 36 by welding or other conventional means.

Front leg 40 is provided with a pattern of nail holes 52 near the upper end. A large bore 54 may also be provided in the front face for securement to the beam or timber as will be explained hereafter. Hole 37 in the rear leg is for temporary securement of the bracket during construction.

Referring to FIGS. 3, 4A and 4B, the installation of a ledger using the apparatus and method of the present invention is shown. The masonary wall 60 consisting of a series of concrete blocks is construction in customary fashion. At the desired elevation for floor or roof, selected blocks 62 are broken away at their face to provide an opening 64. Typically, for most ledger applications this is done on approximately four foot centers as contrasted to use of conventional anchor bolts which requires the anchor bolts to be spaced at much closer locations. Once the blocks are broken away, the hollow interior 66 is accessable and the hangers 30 can be positioned. The hangers are placed at the openings and aligned at the proper elevation with the anchor portion 34 extending into the block as best seen in FIG. 4B. A concrete nail is then installed in hole 37 to hold the hanger in the proper position during the grouting operation. Appropriate grouting 60 is applied in the opening 64 and around the inner leg 44 of the anchor to secure the bracket in place. The rear leg 36 of the bracket engages the vertical inner surface of the wall 60. When this accomplished and the grout is set-up, the contractor removes the nail at 37 and the ledger or timber member 70 can be simply laid in place, snugly received within the U-shaped configuration of the bracket 32. No alignment or drilling of the ledger is required. Horizontal roof or floor member 85, shown as plywood sheeting can then be nailed or otherwise secured to the upper horizontal surface of the ledger and the construction proceeds in conventional manner. Nails 88 are then secured in the member 70 through holes 52 in the front leg of the bracket. If seismic or wind loadings are particularly severe or if local codes require additional securement, a lag bolt 90 may be engaged in the ledger through bore 54.

The hanger of the present invention can be manufactured from any suitable material. As pointed out above, the relative dimensions of the bracket may vary with the application and size of ledger to be secured. Typically, the bracket would be constructed from steel, plastic or equivalent material.

It will be appreciated that the apparatus and method represents a substantial advance over the art providing an efficient and simple method of construction. It will be obvious to those skilled in the art to make various changes, alterations and modifications to the method and apparatus of the present invention. To the extent those changes, alterations and modifications do not depart from the spirit and scope of the appended claims. They are intended to be encompassed therein.

I claim:

1. A method of securing a structural beam member to a masonary wall in a generally horizontal position, said method comprising:

(a) breaking away portions of the wall at selected locations;

(b) providing a hanger having a generally U-shaped bracket and anchor means projecting rearwardly therefrom;

(c) placing said anchor member in said broken away area extending generally horizontally into said wall a distance less than the width of said wall with said bracket in a generally upwardly opening position at said wall;

(d) grouting said broken away area to secure said bracket in place at the wall surface; and (e) allowing the grout to set and placing the structural member in the bracket in the generally horizontal position at the wall surface.

2. The method of claim 1 further including the step of temporarily securing the said hanger to the wall with mechanical fastener means at least during the time the grout is setting up.

3. The method of claim 2 further including the step of securing metal fasteners between said bracket and said structural member.

* * * * *